United States Patent [19]

Nagayasu et al.

[11] Patent Number: 4,531,305

[45] Date of Patent: Jul. 30, 1985

[54] METHOD AND APPARATUS FOR CONTROLLING A CLOTHES DRYER

[75] Inventors: Kuniaki Nagayasu, Akashi; Setsuzou Konno; Toshio Yoshida, both of Osaka, all of Japan

[73] Assignee: Matsushita Electric Industrial Company, Limited, Osaka, Japan

[21] Appl. No.: 503,553

[22] Filed: Jun. 13, 1983

[30] Foreign Application Priority Data

Jun. 17, 1982 [JP] Japan ..... 57-104919

[51] Int. Cl.[3] ..... F26B 21/10

[52] U.S. Cl. ..... 34/31; 34/48; 34/53; 34/55

[58] Field of Search ..... 34/48, 46, 53, 55, 44, 34/30, 31

[56] References Cited

U.S. PATENT DOCUMENTS

| | | | |
|---|---|---|---|
| 3,822,482 | 7/1974 | Cotton | 34/48 |
| 4,267,643 | 5/1981 | Haried | 34/48 |
| 4,286,391 | 9/1981 | Gerry | 34/48 |

FOREIGN PATENT DOCUMENTS

| | | | |
|---|---|---|---|
| 512818 | 4/1979 | Australia . | |
| 528465 | 7/1980 | Australia . | |
| 1521532 | 8/1978 | United Kingdom | 34/48 |

*Primary Examiner*—Larry I. Schwartz

*Attorney, Agent, or Firm*—Lowe, King, Price & Becker

[57] ABSTRACT

In a clothes dryer, the electrical resistance of wet articles and the temperature of exhaust air are monitored. At the instant the monitored electrical resistance reaches a predetermined value, the time-varying rate of change of the monitored temperature is detected, to estimate the period of time for which the dryer operation is to be continued. At the end of the estimated time period, the heat cycle of the dryer is shut down.

11 Claims, 6 Drawing Figures

METHOD AND APPARATUS FOR CONTROLLING A CLOTHES DRYER

BACKGROUND OF THE INVENTION

The present invention relates to a method and apparatus for automatically terminating the operation of a clothes dryer at optimum timing.

Most clothes dryers currently in use include a manually presettable timing device for setting the operating time of the machine. Since this manual setting is based on the user's own experience or manufacturer's guidelines, a substantial amount of energy would be lost if the timer has been set to a longer period than is actually needed or if the user would have to reset the timer again to repeat the operation if the timer is set to a shorter period than optimum.

One prior art approach employed a dryness detector which typically measures the electrical resistance of the clothes to automatically shut off the dryer when a predetermined resistance value is reached. However, there is almost no distinction in electrical resistance value when the dryness factor approaches a 100% value, and precision timing has been difficult to achieve.

SUMMARY OF THE INVENTION

An object of the present invention is therefore to eliminate the disadvantages mentioned above by estimating the time of continued heating operation from the time-varying rate of an operating parameter which varies with the dryness of articles to be dried.

A clothes dryer embodying the invention includes a heater for heating articles of wet clothes and a fan for exhausting moisture-laden air to the outside. With the heater being energized, an operating parameter of the dryer which varies with the dryness of the articles is monitored and the time-varying rate of change of the monitored operating parameter is detected. The detected time-varying rate is used to estimate the period of time during which the heating operation is to be continued. At the end of the estimated time, the heater is de-energized.

Preferably, the dryness of the articles and the temperature of the air exhausted from the dryer are monitored. At the instant the monitored dryness of the articles reaches a predetermined value, the time-varying rate of the monitored temperature is detected to allow estimation of the time period necessary to continue the heating operation.

BRIEF DESCRIPTION OF THE DRAWINGS

The present invention will be described in further detail with reference to the accompanying drawings, in which.

DETAILED DESCRIPTION

Figure 1:
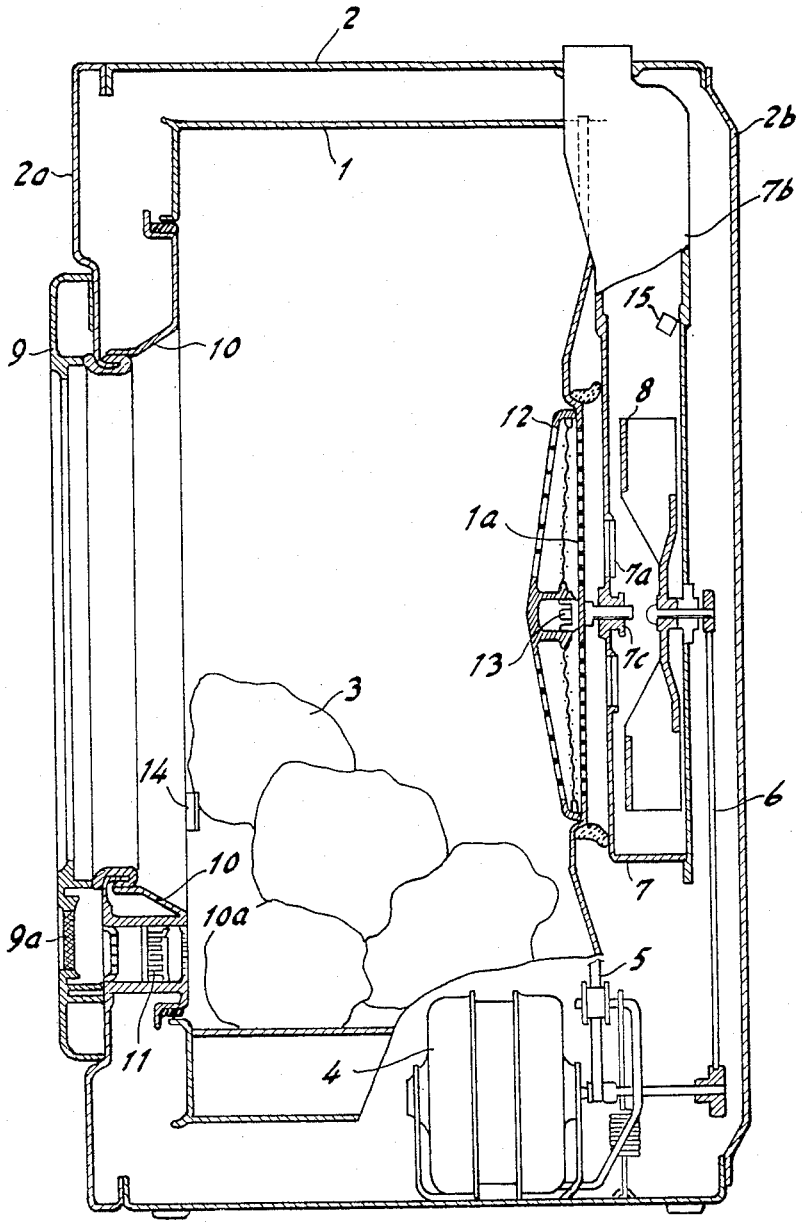
FIG. 1 is a cross-sectional view of a clothes dryer embodying the invention.

A clothes dryer, represented in FIG. 1, comprises a rotary drum 1 rotatably mounted on a bearing 7*c* of a stationary member that forms part of a fan case 7 which is secured to a housing 2. A belt 5 is looped around the circumference of the drum and a drive pulley of a motor 4 to rotate the drum 1 to stir up articles 3 during operation. The housing 2 includes a front panel 2*a* formed with a flange 10 which defines an circular opening and a rear panel 2*b*. The front end of the drum 1 is inwardly flared to define a circular opening in which the flange 10 of the housing 2 is positioned with a small clearance therebetween. The rear end of the drum 1 is formed with slits 1*a* which form part of a filter unit 12 detachably mounted on a shaft 13. A door 9 having a slitted air inlet opening 9*a* is hinged on the flange 10. A heater 11 is located below the flange 10 to heat up air introduced through the opening 9*a*, the heated air being fed through a meshed opening 10*a* into the drum 1. In the fan case 7 is an exhaust suction fan 8 driven by a belt 6 supported between it and the motor shaft. The moisture laden air is forced out by the fan 8 through the filter unit 12 to trap lint, through openings 7*a* and then exhausted outside through a duct 7*b*.

A pair of resistance sensing electrodes 14 is mounted on the flange 10 in a position adjacent to the front edge of the drum 1 to make electrical contact with the wet articles to measure their electrical resistance. A thermistor 15, having a negative resistance-vs-temperature characteristic, is attached to the inner wall of the exhaust duct 7*b* to measure the temperature of the exhausted air.

Figure 2:
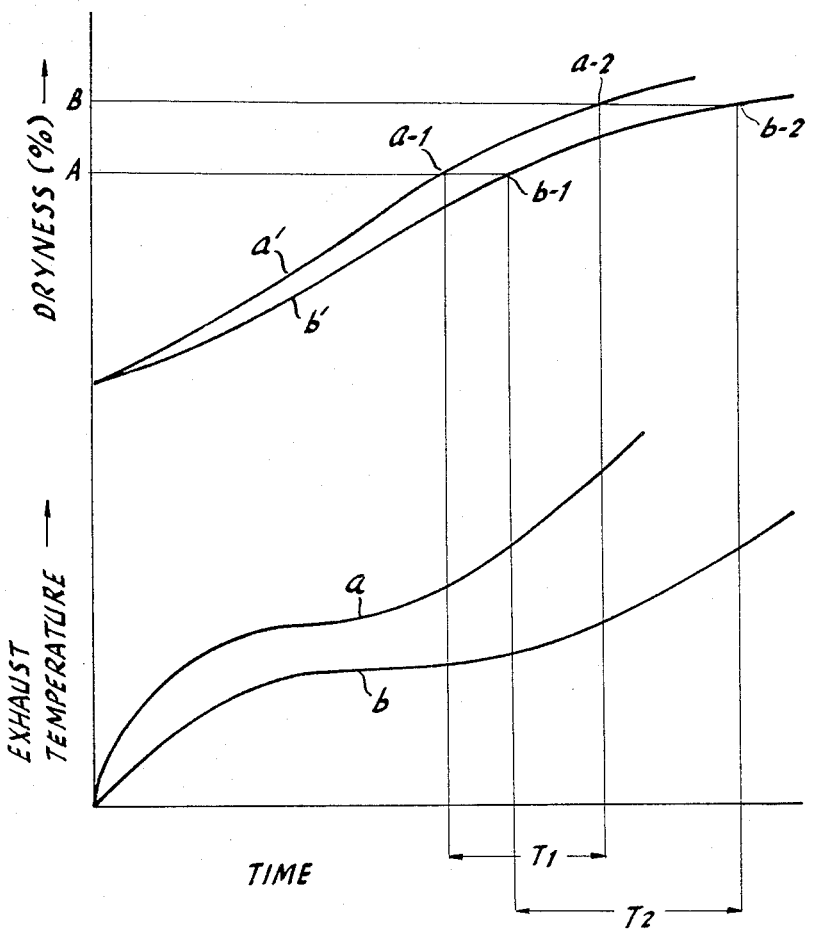
FIG. 2 is a graphic illustration of the operating characteristics of the dryer.

Experiments have been conducted to determine the operating characteristics of the clothes dryer in terms of exhaust temperature and dryness factor for different sets of operating parameters as a function of time. The dryness factor was measured in terms of the weight of wet articles at periodic intervals and plotted on curves a′ and b′, while the exhaust air temperature was measured using a thermistor and plotted on curves a and b, as shown in FIG. 2. The curves a and a′ were derived from a given set of operating parameters as a function of time, and curves b and b′ were obtained from a different set of operating parameters.

Examination of these curves reveals that the exhaust temperature characteristic that prevails in the later period of operation varies in correlation with the dryness characteristic that prevails in the same period and that exhaust temperature varies more rapidly than dryness factor. It was found in the experiments that the electrical resistance of the wet article varies sharply when the dryness factor varies gradually between a value, typically, 95% and a 100% level, respectively designated A and B in FIG. 2. Therefore, the level A is easily determinable by measuring the electrical resistance of the article. It will be seen from FIG. 2 that the period of time $T_1$ between a point a-1 corresponding to the below-100% level A and a point a-2 corresponding to the 100% level B is determinable by the rate of increase in exhaust temperature on curve a, and likewise the time period $T_2$ between a point b-1 corresponding to the level A and a point b-1 corresponding to the 100% level B is determinable by the rate of temperature increase on curve b. Since exhaust temperature is variable as a function of operating parameters including the materials and amount of clothes, ambient temperature, and heater temperature (which depends on AC mains supply), such parameters are reflected in the periods $T_1$ and $T_2$, and therefore, knowing these, the heat cycle can be terminated automatically at optimum time.

Figure 3:
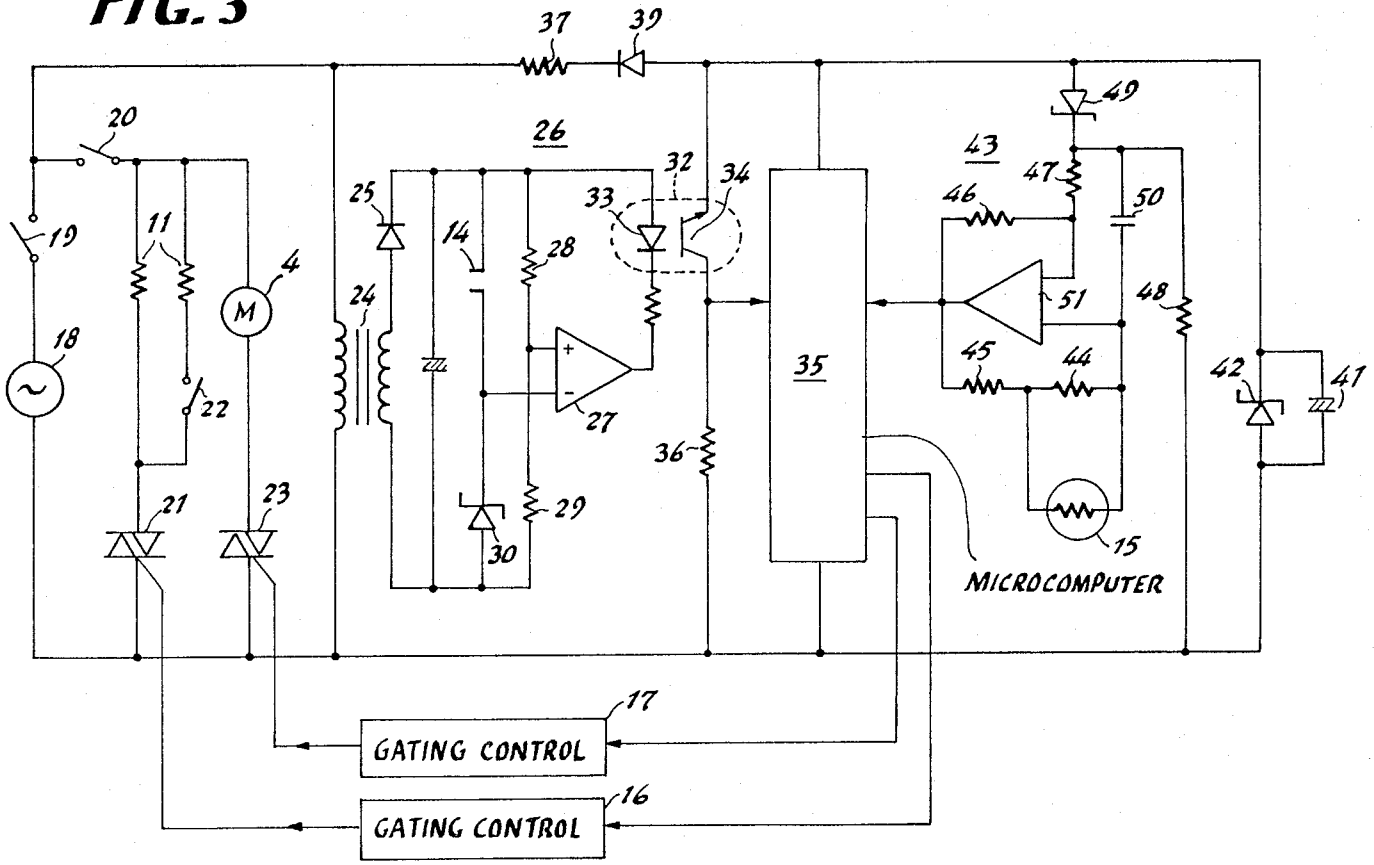
FIG. 3 is a circuit diagram of a dryer control circuit.

FIG. 3 is an illustration of a dryer control circuit embodying the present invention. The control circuit generally comprises a dryness detector 26, an astable multivibrator 43 of a known circuit and a microcomputer 35. The heater 11 is powered from an AC mains supply 18 through a door-operated switch 20 and a power switch 19, the amount of heat generated by the heater 11 being adjustable by a switch 22. The heating level of the heater 11 is controlled by a bidirectionally conducting thyristor 21 whose gating-on pulse is applied from a first gating control circuit 16 which is enabled by a command signal from the microcomputer 35. The motor 4 is similarly energized by the AC mains supply through the switches 19 and 20 and its speed is controlled by a bidirectionally conducting thyristor 23 whose gating-on pulse is applied from a gating control circuit 17. This gating control circuit is also enabled by the microcomputer 35.

A step-down transformer 24 is provided having its primary winding coupled through the power switch 19 to the AC mains supply 18. The dryness detector 26 receives DC power through a diode 25 from the secondary winding of the transformer 24. The resistance sensing electrodes 14 are connected in series with a Zener diode 30 to develop a voltage which is applied to the inverting input of a voltage comparator 27. The noninverting input of the comparator 27 is impressed with a reference voltage obtained from a junction between series-connected resistors 28 and 29. This reference voltage corresponds to the dryness factor A in FIG. 2. The comparator output is coupled through a resistor 31 to a light-emitting diode 33 which forms a photocoupler 32 with a phototransistor 34. The phototransistor 34 has its emitter connected in series with a diode 39 and a resistor 37 to one terminal of the mains supply and has its collector connected in series with a resistor 36 to the other terminal of the mains supply. When the phototransistor 34 is illuminated by the LED 33, a voltage is developed across the resistor 36 and applied to the input port of the microcomputer 35. A parallel combination of a capacitor 41 and a Zener diode 42 is connected to the diode 39 to stabilize the DC voltage supplied to the phototransistor 34, microcomputer 35 and multivibrator 43.

Since the electrical resistance of the articles 3 detected by the electrodes 14 is relatively low during the initial stage of drying operation, the voltage at the inverting input of the comparator 27 is lower than the reference voltage, causing a voltage of positive polarity to appear at the output of the comparator. Therefore, the light-emitting diode 33 is turned off by the positive comparator output until the dryness is lower than the predetermined factor A.

The thermistor 15 forms part of the astable multivibrator 43 which includes a comparator 51, resistors 44 to 48, a capacitor 50 and a Zener diode 49. The thermistor 15 is connected such that the frequency of the multivibrator 43 is proportional to the exhaust temperature. The resistors 44 and 45 serve to provide linearity between the frequency and the exhaust temperature. The output of the multivibrator 43 is applied to a counter of the microcomputer 35 which is reset in response to each oscillation of the temperature indicating signal to count clock pulses of the microcomputer. The output of the counter is a binary representation of the exhaust temperature.

The operation of the microcomputer 35 will now be described with reference to a flowchart shown in FIGS. 4*a* and 4*b*. With the dryer loaded with wet articles and door 9 being closed, the operation of power switch 19 energizes the microcomputer 35. The microcomputer 35 starts program execution at Step 100 by enabling the gating control circuits 16 and 17 to apply gating-on pulses to the thyristors 21 and 23 to start drying operation in a heat-up cycle. When the articles have been dried to the predetermined dryness value A, the voltage at the inverting input of comparator 27 exceeds the reference voltage, the output of this comparator switches to a negative voltage and turns on the light-emitting diode 33. As a result, the phototranistor 34 is rendered conductive, causing a voltage to develop across the resistor 36. When this occurs, the exhaust temperature value is registered in the microcomputer to introduce a delay time according to the rate of increase in the exhaust temperature.

More specifically, the microcomputer 35 checks whether the output of the dryness detector 26 is at high voltage level (logical "1") at Step 101, and if so, advances to a Step 102 to store the exhaust temperature datum "t" from the oscillator 43 into a first temperature counter TEMP1. Successively, at Step 103, the same temperature datum "t" is stored in a second temperature counter TEMP2. At Step 104, the datum stored in temperature counter TEMP1 is subtracted from the datum stored in temperature counter TEMP2 to derive a differential value T. A counter C is incremented at Step 105 each time the Step 104 is executed. The microcomputer checks if the differential value T equals a predetermined differential value $\Delta T$ at Step 106, and if not, it repeats the Steps 103 to 106 to increment the C value until $T=\Delta T$ is obtained, and goes to a Step 107. The C value thus obtained represents the time period during which the exhaust temperature has increased by an incremental temperature represented by the differential value $\Delta T$.

The microcomputer includes a read only memory in which a set of coefficients f(C) is stored in locations addressible as a function of the count value C. The coefficient f(C) is predetermined by experiments to predict the amount of delay time to be introduced between the time of occurrence of the detector 26 output and the time at which the dryness will reach 100% level. To this end, the microcomputer 35 exits to a Step 107 when $T=\Delta T$ is obtained at Step 106 to multiply C by a coefficient f(C) to derive a delay time value DL. If the exhaust temperature curves a and b during the later stage of operation can be considered linear, the count value C may be multiplied by a constant K. The counter C is reset to zero at Step 108.

A delay time is now introduced by incrementing a delay time counter P by "1" at Step 109, which is followed by a Step 110 in which the count value P is checked against the delay time value DL. If the delay time value DL is not reached, the Steps 109 and 110 are repeated until P=DL is reached. When this occurs, the delay time counter P is reset to zero at Step 111 and the microcomputer goes to a Step 112 to remove the gating-on pulses applied to the thyristor 21 by disabling the gating control circuit 16, terminating the heat-up cycle.

A cool-down cycle now commences at Step 113 to allow the dried articles to be cooled down by cool air while the drum continues to be driven by motor 4. In this step, a counter Q is checked against a delay time value Qr which represents the time period necessary to continue the cool down cycle. A Step 114 is executed by incrementing the Q value if Q=Qr is not obtained at Step 113. Steps 113 and 114 are thus repeated until a "yes" decision is made in Step 113, whereupon the counter Q is reset to zero at Step 115 and the microcomputer removes gating-on pulses from the thyristor 23 at Step 116 by disabling the gating control circuit 17.

Figure 4A:
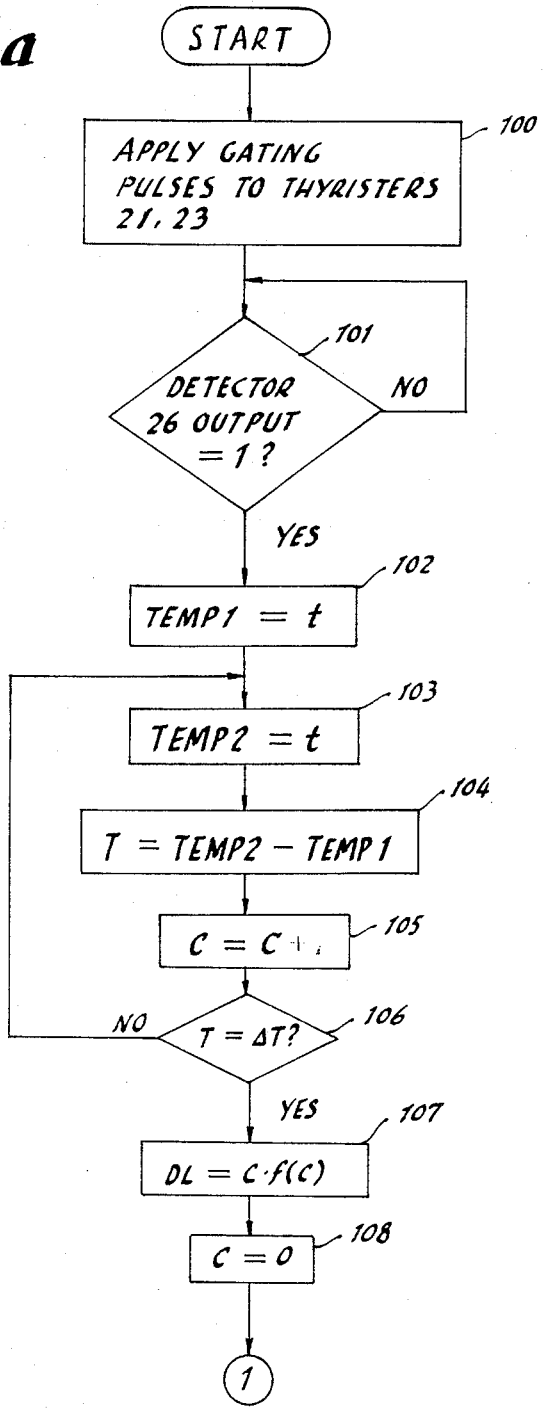
FIGS. 4*a* and 4*b* are illustrations of a flowchart describing the instructions performed by the microcomputer of FIG. 3.
Figure 4B:
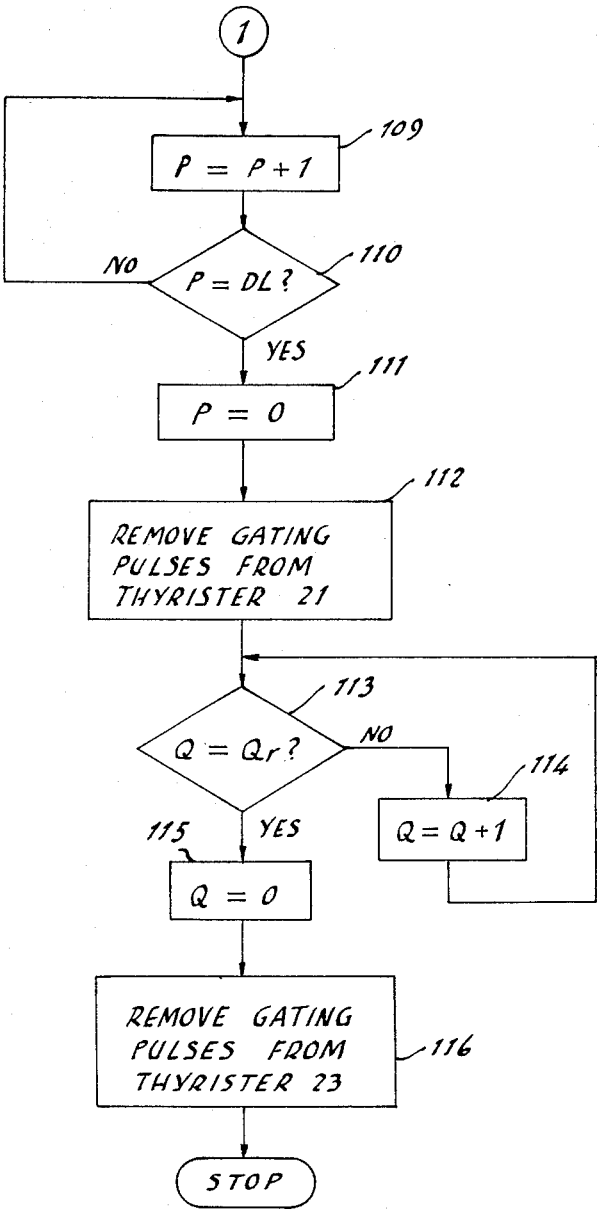
Figure 5:
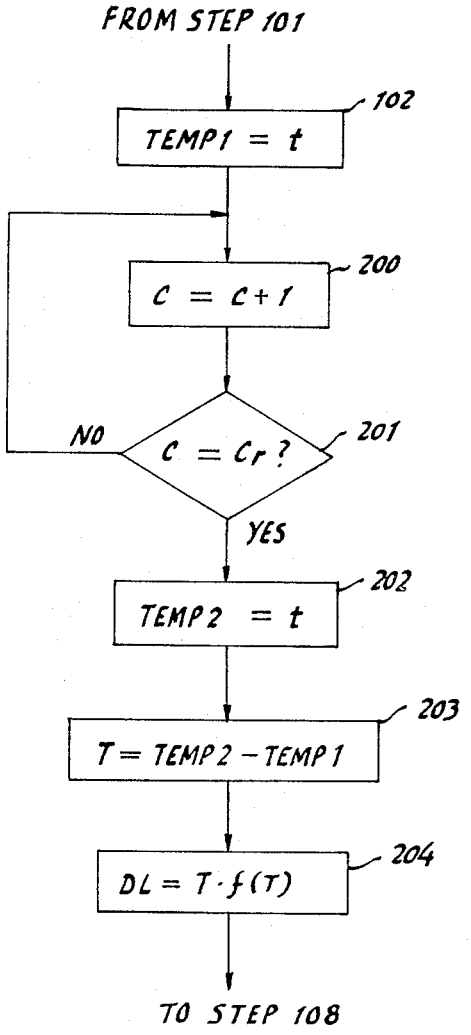
FIG. 5 is an alternative flowchart for the microcomputer.

FIG. 5 shows another flowchart, in which Steps 200 to 204 replace the Steps 103 to 107 of the flowchart shown in FIG. 4*a*. From the Step 102, the microcomputer exits to Step 200 to increment the counter C by "1", followed by a Step 201 where the count value C is checked against a reference value Cr representing a unit time period during which the exhaust temperature has increased. If C is not equal to Cr, Steps 200 and 201 are repeated. When the predetermined value Cr is reached, the second temperature counter TEMP2 is loaded with the exhaust temperature value "t" at Step 202. A differential temperature value T is derived by taking the difference between the count values TEMP1 and TEMP2 at Step 203. This differential value is used in Step 204 to address a coefficient value f(T) from the read only memory as a function of T in a manner similar to that described previously and the T value is multiplied with the coefficient f(T) to obtain a delay time DL.

What is claimed is:

1. A method for controlling a clothes dryer having a rotary drum in which wet articles are dried, a fan located in an exhaust passage of the dryer for causing air to be drawn through an air intake passage into said drum and exhausted through said exhaust passage to the outside, a heater located in said air intake passage, an electrical resistance measurement means for measuring the electrical resistance of said articles, and a temperature measurement means for monitoring the temperature of said exhaust air in said exhaust passage, comprising the steps of:

(a) energizing said heater to increase the dryness of said articles;

(b) measuring said electrical resistance of said articles to detect when said electrical resistance reaches a predetermined value representative of a near 100% dryness;

(c) monitoring said exhaust air temperature;

(d) in response to said predetermined value of said electrical resistance, determining the rate of variation of said monitored exhaust air temperature with respect to time;

(e) estimating a time period of a duration based on said rate of variation of exhaust air temperature; and (f) de-energizing said heater at the termination of said estimated time period.

2. A method as claimed in claim 1, wherein the step (d) comprises: determining the rate of increase in said monitored exhaust air temperature in response to said predetermined value.

3. Apparatus for a clothes dryer having a manually operated switch, a rotary drum in which wet articles are dried, a fan located in an exhaust passage of the dryer for causing air to be drawn through an air intake passage into said drum and exhausted through said exhaust passage to the outside, and a heater located in said air intake passage and arranged to be energized in response to the operation of said switch, comprising:

means for monitoring the electrical resistance of said articles;

means for monitoring the temperature of the air in said exhaust passage; and data processing means for detecting when said monitored electrical resistance reaches a predetermined value, determining the time-varying rate of change of said monitored temperature in response to said predetermined value being reached, estimating a time period on the basis of said time varying rate, and denergizing said heater at the termination of said estimated time period.

4. Apparatus as claimed in claim 3, wherein said data processing means comprises a microcomputer programmed to perform the following steps:

(a) detecting when said electrical resistance reaches said predetermined value;

(b) storing a first datum representing said monitored temperature in a memory;

(c) storing a second datum representing said monitored temperature in a memory;

(d) detecting the difference between said first and second data;

(e) incrementing the count value of a counter by one;

(f) detecting a match between said difference and a predetermined differential value;

(g) if said match is not present, repeating the steps (c) to (f) to cause said count value to be incremented until a match is detected in the step (f);

(h) if said match is present, introducing a delay time corresponding to said count value; and (i) de-energizing said heater in response to said termination of said delay time.

5. Apparatus as claimed in claim 4, wherein the step (i) comprises multiplying said count value by a coefficient to derive a delay time datum and introducing said delay time corresponding to said delay time datum.

6. Apparatus as claimed in claim 5, wherein said coefficient is a constant.

7. Apparatus as claimed in claim 5, wherein said coefficient is variable as a function of said count value.

8. Apparatus as claimed in claim 3, wherein said data processing means comprises a microcomputer programmed to perform the following steps:

(a) detecting when said electrical resistance reaches said predetermined value;

(b) storing a first datum representing said monitored temperature in a memory;

(c) incrementing the count value of a counter until it reaches a predetermined value;

(d) storing a second datum representing said monitored temperature in a memory;

(e) detecting the difference between said first and second data;

(f) introducing a delay time corresponding to said detected difference; and (g) de-energizing said heater in response to said termination of said delay time.

9. Apparatus as claimed in claim 8, wherein the step (f) comprises multiplying said detected difference by a coefficient to derive a delay time datum and introducing said delay time corresponding to said delay time datum.

10. Apparatus as claimed in claim 9, wherein said coefficient is a constant.

11. Apparatus as claimed in claim 9, wherein said coefficient is variable as a function of said detected difference.

* * * * *